US005381908A

United States Patent [19]

Hepp

[11] Patent Number: 5,381,908

[45] Date of Patent: Jan. 17, 1995

[54] ORGANIZER FOR GROCERY SHELVES

[75] Inventor: James Hepp, Glen Cove, N.Y.

[73] Assignee: All Stock Displays Inc., Glen Head, N.Y.

[21] Appl. No.: 123,782

[22] Filed: Sep. 20, 1993

[51] Int. Cl.[6] ..... A47F 5/00

[52] U.S. Cl. ..... 211/184; 40/642; 108/61; 248/221.4

[58] Field of Search ..... 211/184; 40/642; 108/60, 61; 248/221.4, 223.3, 225.1, 298

[56] References Cited

U.S. PATENT DOCUMENTS

| | | | |
|---|---|---|---|
| 2,830,394 | 4/1958 | Gordon et al. . | |
| 2,927,701 | 3/1960 | Lynde | 248/221.4 X |
| 3,071,880 | 1/1963 | Taub | 40/642 |
| 3,214,122 | 10/1965 | Frederickson | 248/221.4 |
| 4,881,707 | 11/1989 | Garfinkle | 248/221.4 |
| 4,896,779 | 1/1990 | Juveckson | 211/184 |
| 5,161,704 | 11/1992 | Valiulis | 211/184 |
| 5,217,124 | 6/1993 | Stone | 211/184 |

*Primary Examiner*—Robert W. Gibson, Jr.

*Attorney, Agent, or Firm*—Kane, Dalsimer, Sullivan, Kurucz, Levy, Eisele and Richard

[57] ABSTRACT

The device is a shelf organizer. A clip portion slidably snap engages inwardly facing tracks of a grocery shelf. A post portion attached by a living hinge to the clip portion extends vertically therefrom. The post portion snap engages a planar shelf divider and includes a slot through which a tongue portion of the planar shelf divider passes. The tongue portion includes a flat surface onto which prices and product information may be affixed.

7 Claims, 2 Drawing Sheets

ORGANIZER FOR GROCERY SHELVES

BACKGROUND OF THE INVENTION

1. Field of the Invention

This invention pertains to a sliding bracket which is used as an organizer for shelves, particularly grocery shelves.

2. Description of the Prior Art

Business conditions have made the grocery store industry very competitive. Profit margins are minimal. This requires that all shelf space be used effectively. In fact, shelf space is so valuable that purveyors of new grocery products must frequently pay a fee to a grocery store for the grocery store to stock the new product on its shelves. In order to optimize the use of grocery store space, several things are required—the products must be easy for the shopper to find, the products must be arranged in an orderly and pleasing manner for the grocery store to retain its customer base, the grocer must know immediately when to replenish grocery products on the grocery shelves, and the products must be arranged in an efficient manner to optimize the use of available shelf space with a minimum of clutter. These requirements must be met not only by an inexpensive device, but the device must also be simple and reliable in the face of employees chosen from a pool of a wide and uneven range of abilities.

These requirements are even further strengthened if the grocery store intends to cater to the upper end of the market where the profit margins are perhaps somewhat higher than the remainder of the market. In addition to having a clean store and a well-mannered staff, it is particularly important to achieve the above requirements when catering to this market segment.

These requirements have not been effectively met by a single item in the prior art.

These requirements can be met, in part, by the use of shelf organizers which are adaptable to the standard grocery store shelves, are slidable on the standard tracks of grocery store shelves so as to allow a particular product to have the exact amount of shelf space needed (particularly as the shelved supply of product dwindles), and include product labels which are prominent to the shoppers as they walk down the shopping aisle, without requiring shoppers to turn their heads to see each and every piece of product information.

OBJECTS AND SUMMARY OF THE INVENTION

It is therefore an object of this invention to provide a device to optimize the use of grocery shelves.

It is therefore a further object of this invention to provide a device to organize the use of grocery shelves and to provide a neat and orderly display of products.

It is therefore a still further object of this invention to provide a prominent product label to the shopper thereby allowing the shopper to find the desired product quickly.

It is therefore a still further object of this invention to provide a device to easily and quickly organize a grocery shelf in response to declining stock thereby indicating that grocery products should be replenished and further allowing all available space on a shelf to be used.

It is therefore a still further object of this invention to provide a device to organize grocery shelves which can adapt to a variety of shelf dividers.

It is therefore a final object of this invention to provide an inexpensive and simple to use device.

These and other objects are achieved by providing a shelf organizer which includes a clip portion which slides or "rides" within the standard rail on the edge of a grocery store shelf. The clip portion is attached to an upwardly extending post or support portion via a living hinge. The support portion includes a vertical slot to engage a shelf divider made of dye cut mount board, vinyl, cardboard, or similar material. The shelf divider includes a tongue element which extends through the vertical slot thereby providing a flat surface for a product label which is in the line of sight of the passing shopper and therefore readily apparent to the shopper. Similarly, the main portion of the shelf divider can be imprinted with the product name, thereby providing a wholesaler with the incentive to provide the grocery store with proprietary shelf dividers. The position of the shelf organizer along the rail on the edge of the grocery shelf can be adjusted to provide the exact amount of room required for an orderly display of the grocery products. As the shelved items dwindle due to sales, the shelf organizers can be pushed closer to each other to optimize the use of the shelf space. Additionally, this movement of the shelf organizers, in combination with the product labels, can readily indicate to store employees the need to replenish a specific grocery product on the shelves.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
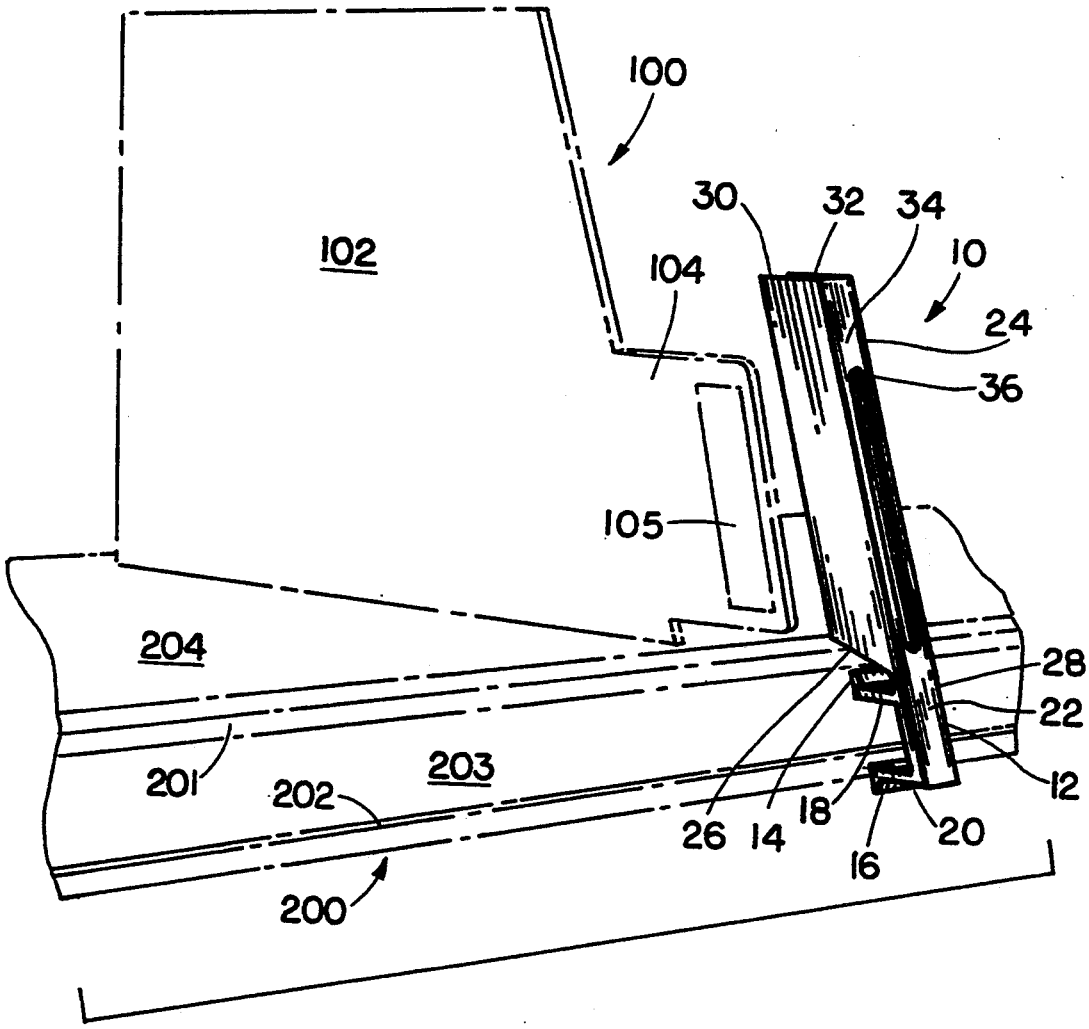
FIG. 1 is a perspective view of the organizer of the present invention in exploded relationship with the grocery shelf and the divider sheet shown in phantom.

Referring now to the drawings in detail wherein like numerals refer to like elements throughout the several views, one sees that FIG. 1 is a perspective view of shelf organizer 10, shown in exploded relationship with shelf divider 100 and grocery shelf 200.

Shelf organizer 10, which is typically formed from injection molded plastic, includes lower clip portion 12 with upwardly extending leg 14 and downwardly extending leg 16 which engage the respective opposite inwardly facing tracks 201, 202 of grocery shelf 200. Legs 14, 16 engage tracks 201, 202 in a resilient manner vertically to maintain the connection between shelf organizer 10 and grocery shelf 200, but engage tracks 201, 202 in a sliding manner horizontally to allow shelf organizer 10 to be slid along edge 203 of grocery shelf 200. Tracks 201, 202 are regularly provided on the edge 203 of grocery shelf 200 in order to engage resilient price labels (not shown) and the like which snap engage between the two tracks 201, 202. Track 201 is frequently somewhat inward of track 202 so as to upwardly incline edge 203 of grocery shelf 200 so as to upwardly incline the price labels (not shown) to be more easily viewed by the shopper.

Walls 18, 20 extend substantially horizontally from the inward edges of legs 14, 16, respectively, and forward surface 22 extends substantially vertically (at the slight inclination of edge 203 as described hereinabove) from the forward edges of walls 18, 20. Legs 14, 16, walls 18, 20 and forward surface 22 are made of a resilient material, such as injection-molded plastic, to allow the user to squeeze walls 18, 20 together somewhat to allow legs 14, 16 to engage or disengage tracks 201, 202.

Upwardly extending from wall 18 of clip 12 at an angle slightly inclined from the vertical is post or support element 24. The lower end 26 of support element 24 is secured to wall 18 by a living hinge 28 which bends in order to accommodate minor variations in angle as dictated by the shape of shelf divider 100.

Support element 24 includes an inwardly facing U-shaped cross section as viewed from above as formed by sidewalls 30, 32 which are perpendicular to the horizontal merchandise surface 204 of grocery shelf 200 and by forward wall 34 (illustrated as continuous with forward surface 22 via living hinge 28). Sidewalls 30, 32 have an interior spacing therebetween chosen so that sidewalls 30, 32 can firmly snap engage shelf divider 100, typically made dye cut mount board, vinyl, cardboard, or similar material, therebetween. Additionally, while not shown in the drawings, the main body 102 of shelf divider 100 can be imprinted with the product name, thereby providing a wholesaler with the incentive to provide the grocery store with proprietary shelf dividers 100.

Figure 2:
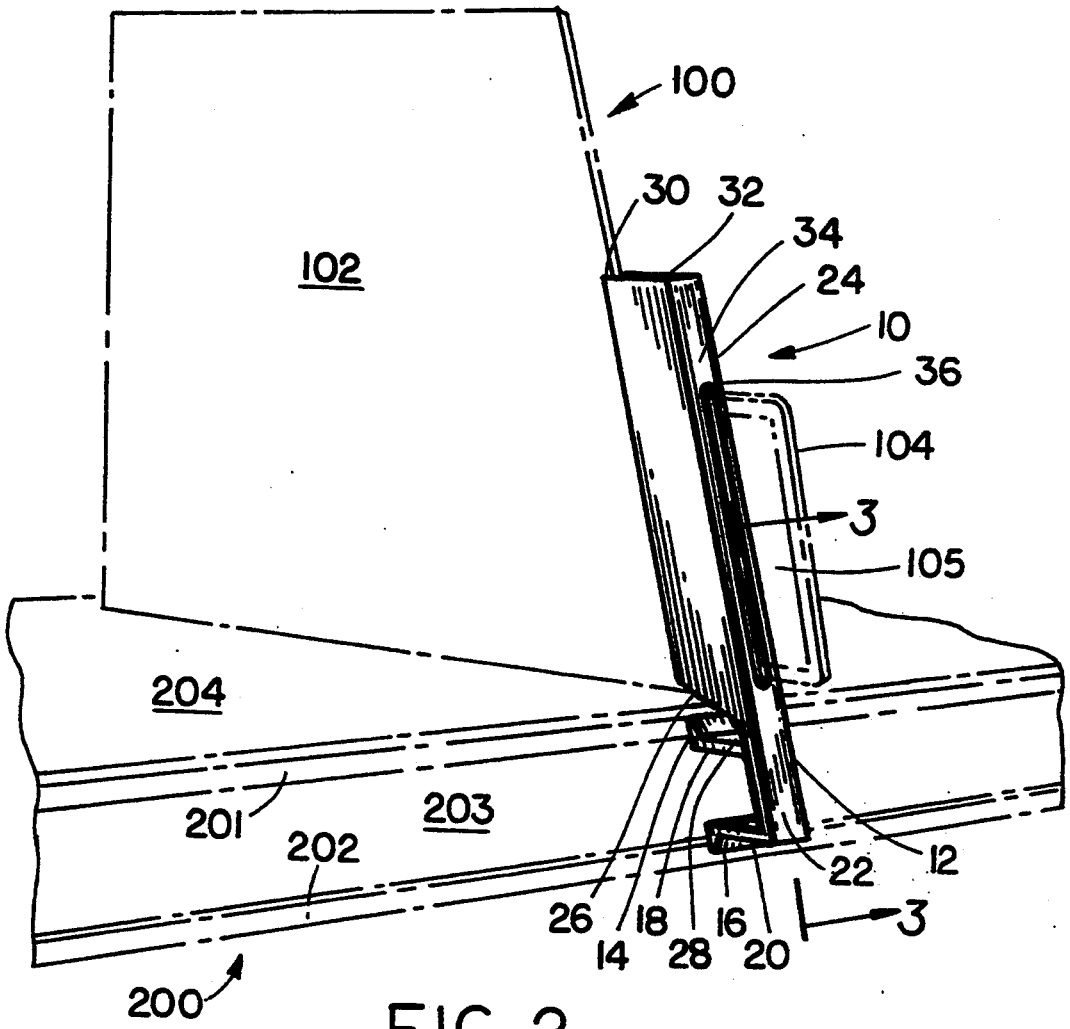
FIG. 2 is a perspective view of the organizer of the present invention in relationship with the grocery shelf and the divider sheet shown in phantom.
Figure 3:
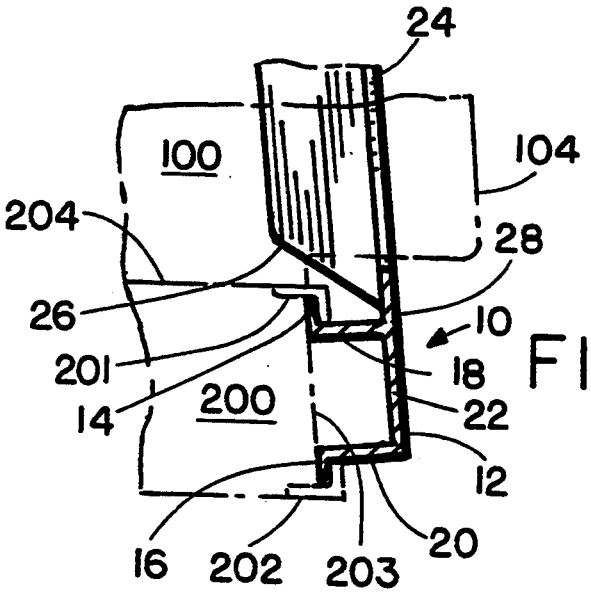
FIG. 3 is a cross-sectional view taken along plane 3—3 of FIG. 2.

Forward wall 34 includes vertical slot 36 through a portion thereof. As best shown in FIG. 2, tongue 104 of shelf divider 100 is inserted through vertical slot 36. Area 105 of tongue 104, similar to main body 102, can be printed with the product name on a proprietary shelf divider 100. Alternatively, area 105 of tongue 104 provides a surface for the grocer to provide the product name and additional information, such as price, container size and sale status. As both main body 102 and area 105 of tongue 104 of shelf divider 100 provide a surface for the product name and similar information and are typically perpendicular to the aisle of the grocery store, this information is projected within the line of sight of the passing shopper more effectively than similar information provided in a standard configuration on the edge 203 of grocery shelf 200, parallel to the grocery aisle, which requires shoppers to turn their heads to see the information.

The order of steps to use shelf organizer 10 is very flexible, particularly as to the order of the placement of the grocery products, shelf organizer 10, shelf divider 100, and the product label of tongue 104. However, a typical order of installation is that the grocery store employee places the grocery products on shelf 200 and places shelf dividers 100 therebetween in a neat and organized manner. The grocery store employee then slips tongue portion 104 of shelf divider 100 through vertical slot 36 of shelf organizer 10 and squeezes walls 18, 20 of clip portion 12 together somewhat to allow legs 14, 16 to engage tracks 201, 202 of shelf 200. The employee can then slide shelf organizer 10 along tracks 201, 202 to further organize the grocery products. The employee can then place a product label (including price or similar information) on area 105 of tongue 104 if this information has not already been preprinted on a proprietary shelf divider 100. As the supply of shelved grocery product decreases, the product name, if printed on main body 102 of shelf divider 100 comes within the line of sight of the passing shopper. The grocery store employee can slide shelf organizer 10 along tracks 201, 202 to conserve shelf space as the supply of shelved product dwindles. The product labels on body 102 and tongue 104 further indicate to both the grocery store employee and the shopper when a product needs to be replenished on the shelves.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A shelf organizer comprising:

clip means for slidably engaging an edge of a shelf;

post means extending substantially vertically from said clip means, said post means further including means for engaging a planar dividing means generally perpendicular to the edge of the shelf, said post means having a U-shaped cross section with a first inwardly extending post leg and a second inwardly directed post leg, said first and second post legs being resiliently engaged with respect to each other and spaced to engage the shelf divider therebetween and including a vertical slot through which a tongue portion of the shelf divider passes; and living hinge means attaching said clip means to said post means.

2. The shelf organizer of claim 1 wherein said clip means includes a substantially upwardly extending leg and a substantially downwardly extending leg, said legs being resiliently engaged with respect to each other thereby allowing said legs to be snap engaged to opposite inwardly facing tracks on the edge of the shelf.

3. The shelf organizer of claim 2 wherein said legs are resiliently engaged with respect to each other by an integral resilient structure therebetween.

4. The shelf organizer of claim 3 wherein said integral resilient structure includes a first wall extending substantially horizontally from said first leg, a second wall extending substantially horizontally from said second leg, and a surface extending substantially vertically between said first and second walls.

5. The shelf organizer of claim 4 wherein said integral resilient structure is formed of injection molded plastic.

6. The shelf organizer of claim 1 wherein a bottom surface of said post means inwardly adjacent from said living hinge includes an indented portion for engaging the shelf.

7. The shelf divider of any of claims 1 through 6 in combination with a planar shelf divider including a main body portion and a tongue portion.

* * * * *